US007341096B2

(12) United States Patent
Van Der Winden

(10) Patent No.: US 7,341,096 B2
(45) Date of Patent: Mar. 11, 2008

(54) METHOD FOR PROCESSING A CONTINUOUSLY CAST METAL SLAB OR STRIP, AND PLATE OR STRIP PRODUCED IN THIS WAY

(75) Inventor: Menno Rutger Van Der Winden, Leiden (NL)

(73) Assignee: Corus Technology BV, Ijmuiden (NL)

( * ) Notice: Subject to any disclaimer, the term of this patent is extended or adjusted under 35 U.S.C. 154(b) by 35 days.

(21) Appl. No.: 10/487,434

(22) PCT Filed: Aug. 16, 2002

(86) PCT No.: PCT/NL02/00547

§ 371 (c)(1),
(2), (4) Date: Aug. 23, 2004

(87) PCT Pub. No.: WO03/018223

PCT Pub. Date: Mar. 6, 2003

(65) Prior Publication Data

US 2005/0000678 A1 Jan. 6, 2005

(30) Foreign Application Priority Data

Aug. 24, 2001 (NL) ..... 1018817

(51) Int. Cl.
*B22D 11/06* (2006.01)

(52) U.S. Cl. ..... 164/476; 148/552; 148/437

(58) Field of Classification Search ..... 164/476; 148/552, 320, 437; 29/527.7
See application file for complete search history.

(56) References Cited

U.S. PATENT DOCUMENTS

| | | | | |
|---|---|---|---|---|
| 2,250,541 A | | 7/1941 | Lessmann | 72/12.4 |
| 3,811,307 A | | 5/1974 | Vydrin et al. | 72/205 |
| 3,823,593 A | | 7/1974 | Vydrin et al. | 72/205 |
| 4,145,902 A | | 3/1979 | Imai et al. | 72/8.6 |
| 4,173,133 A | | 11/1979 | Imai et al. | 72/8.4 |
| 4,238,248 A | | 12/1980 | Gyongyos et al. | |
| 4,299,103 A | | 11/1981 | Marten | 72/11.8 |
| 4,339,287 A | * | 7/1982 | Matsumoto et al. | 148/111 |
| 4,365,496 A | | 12/1982 | Shiozaki et al. | 72/249 |
| 4,385,511 A | | 5/1983 | Vydrin | 72/205 |
| 4,400,963 A | | 8/1983 | Epps | 72/250 |
| 4,406,715 A | * | 9/1983 | Nakayama et al. | 148/111 |
| 4,437,909 A | * | 3/1984 | Mori et al. | 148/111 |
| 4,473,416 A | * | 9/1984 | Kawamo et al. | 148/111 |
| 4,477,011 A | * | 10/1984 | Austin | 228/173.2 |
| 4,478,064 A | | 10/1984 | Brenneman | 72/232 |
| 4,727,927 A | * | 3/1988 | Popik | 164/452 |
| 4,781,050 A | | 11/1988 | Winter et al. | 72/241 |
| 5,665,180 A | | 9/1997 | Seetharaman et al. | |
| 5,894,879 A | | 4/1999 | Wyatt-Mair et al. | |

FOREIGN PATENT DOCUMENTS

| | | |
|---|---|---|
| CN | 1035450 | 9/1989 |
| JP | 55033851 | 3/1980 |
| JP | 55045507 | 3/1980 |
| JP | 55094707 | 9/1980 |
| JP | 56099004 | 8/1981 |
| JP | 57175005 | 10/1982 |
| JP | 61052317 | 3/1986 |
| JP | 4187747 | 7/1992 |
| JP | 05318045 | 12/1993 |
| JP | 07333437 | 12/1995 |
| JP | 11254093 | 9/1999 |
| RU | 2006299 | 1/1994 |
| RU | 94023404 | 4/1996 |
| RU | 2100108 | 12/1997 |
| SU | 63448 | 4/1944 |
| SU | 674806 | 8/1979 |
| SU | 858955 | 8/1981 |
| SU | 880522 | 11/1981 |
| SU | 1061861 | 8/1982 |
| SU | 1629117 | 2/1991 |
| SU | 1731533 | 5/1992 |
| SU | 1789315 | 1/1993 |
| WO | 97000148 | 1/1997 |

OTHER PUBLICATIONS

U.S. Appl. No. 2005/0034500 Al, (Appl. No. 10/487,436), Van Der Winden et al., Filed Aug. 16, 2002, published Feb. 17, 2005.

U.S. Appl. No. 2007/0051439 A1, (Appl. No. 10/546,192, Van Der Winden et al., Filed Oct. 3, 2006, published Mar. 8, 2007.

Office Action of Jul. 3, 2007 from U.S. Appl. No. 10/487,146.

Office Action of Apr. 16, 2007 from U.S. Appl. No. 10/487/436.

Office Action of Sep. 12, 2007 from U.S. Appl. No. 10/487,436.

* cited by examiner

*Primary Examiner*—Kevin P. Kerns
(74) *Attorney, Agent, or Firm*—Stevens, Davis, Miller & Mosher, LLP

(57) ABSTRACT

The invention relates to a method for processing a continuously cast metal slab or strip, in which the slab or strip is passed between a set of rotating rolls of a rolling mill stand in order to roll the slab or strip. According to the invention, the rolls of the rolling mill stand have different peripheral velocities, and the difference in peripheral velocity is at least 5% and at most 100%, and the thickness of the slab or strip is reduced by at most 15% for each pass. The invention also relates to metal plate or strip produced using this method.

24 Claims, No Drawings

METHOD FOR PROCESSING A CONTINUOUSLY CAST METAL SLAB OR STRIP, AND PLATE OR STRIP PRODUCED IN THIS WAY

The invention relates to a method for processing a continuously cast slab or strip, in which the slab or strip is passed between a set of rotating rolls of a rolling mill stand in order to roll the slab or strip.

Rolling is a very standard processing operation for imparting desired dimensions and properties to metals. For example, rolling results in an improvement to the microstructure as a result of grain refinement taking place under the influence of the rolling.

If thin plate or strip is to be produced from a thick slab of, for example, 30 cm or more, the production of thin plate or strip is a very laborious process, since rolling has to be repeated a very large number of times. Therefore, other casting techniques have been developed in order to obtain a thin slab or a strip directly. In order still to produce sufficient material, these processes are carried out continuously.

For the continuous casting of aluminum, in principle three methods can be distinguished which are currently in use. The first method uses one cooled roll on which a thin layer of molten aluminum is cooled until it solidifies. The strip obtained in this way has a thickness of approximately 1 mm. For technical reasons, this thickness cannot be much greater. The second method uses two cooled rolls between which molten aluminum is passed in order to solidify into a strip. The improved cooling means that this method usually produce a thickness of between 6 and 10 mm; the minimum thickness which can currently be achieved is approximately 1 mm. Depending, inter alia, on the thickness, the strip which is formed will be cut into slabs or coiled. In the third method, the molten aluminum is guided onto a conveyer belt, on which it solidifies, or passed between two conveyer belts in order to solidify. On account of the longer solidification path, more heat can be dissipated and it is possible to produce a thicker solidified strip. The thickness is usually approximately 20 mm. The thick strip formed in this way can then be cut in slabs or coiled. In all three methods, it is also possible for the strip to be rolled in one or more rolling mill stands immediately after the continuous casting and then to be coiled.

The above three methods or also other methods can be used for the continuous casting of other metals, and if appropriate it is also possible to produce a thicker strip.

These methods and methods derived from them are in the present context jointly referred to as "continuous casting", and the product obtained thereby is referred to as "continuously cast slab or strip".

One drawback of these products is that the end product still largely has the cast microstructure, since the slabs and the strip have scarcely been rolled. Consequently, the mechanical properties of the end products are relatively poor, and consequently the use of the end products is relatively limited, for example as a foil and a starting material for fins of heat exchangers and the like.

It is an object of the invention to provide a method for processing a continuously cast metal slab or strip which allows the properties of the product produced thereby to be improved.

It is another object of the invention to provide a method for processing a continuously cast metal slab or strip with which it is possible to close up pores in the cast material.

Yet another object of the invention is to provide a method for processing a continuously cast metal slab or strip which results in grain refinement in the product which is thereby produced.

Yet another object of the invention is to provide a method for processing continuously cast metal by means of which the surface of the slab or strip is improved.

It is also an object of the invention to provide a metal plate or strip with improved mechanical properties which is preferably produced with the aid of this method.

According to a first aspect of the invention, one or more of these objects are achieved by a method for processing a continuously cast slab or strip, in which the slab or strip is passed between a set of rotating rolls of a rolling mill stand in order to roll the slab or strip, in which method the rolls of the rolling mill stand have different peripheral velocities, and the difference in peripheral velocity is at least 5% and at most 100%, and in which method the thickness of the slab or strip is reduced by at most 15% for each pass.

As a result of the rolls being provided with a different peripheral velocity, shearing occurs in the slab or strip and has been found to occur throughout the entire thickness of the slab or strip. It has been found that this requires a velocity difference of at least 5%. The shearing leads to pores in the continuously cast material being closed up to a considerable extent. This does not require a major change in thickness, but rather a change in thickness of at most 15% can suffice. This is advantageous in a continuously cast metal slab or strip, which in many cases is cast with a low thickness, because the thickness is then substantially retained.

In addition, it is important that the rolling according to the invention can result in a grain refinement which occurs throughout the entire thickness of the rolled material, which is advantageous for the mechanical properties of the slab or strip. Inter alia, the strength of the material increases.

The shearing also breaks up the eutectic particles, which results in an improved toughness.

In addition, it is expected that the material will have an improved fatigue crack growth rate, since the grains will have a more or less knurled shape as a result of the shearing. This results in an improved toughness and a reduced susceptibility to damage.

It is also expected that the processing according to the invention will result in a rolled sheet with less lateral spread.

It is also expected that the processing according to the invention will cause the surface layer of the material to be different than is the case with conventional rolling of the material. Ordinary rolling results in the formation of a layer comprising very fine-grained material. This layer is much thinner in the processing according to the invention. The expectation is that this will improve the corrosion resistance of the material. This may be favorable for the use of continuously cast aluminum plates and strip material for applications other than the current ones.

The thickness of the slab or strip is preferably reduced by at most 8% for each pass, and preferably by at most 5% for each pass. Since the shearing and therefore the grain refinement are brought about by the difference in peripheral velocity between the rolls, the reduction in thickness of the material is not necessary in order to obtain grain refinement. The reduction in thickness is required primarily in order to enable the rolls to grip the material. This only requires a slight change in thickness, which is advantageous in the case of thin continuously cast aluminum slabs and strip material. The smaller the reduction, the thicker the slab or strip remains after each pass. The possible applications of continuously cast aluminum slabs and strip material increase as a result.

The difference in peripheral velocity is preferably at most 50%, more preferably at most 20%. If there is a high difference in veloeity, there is a considerable risk of slipping between the rolls and the material, which would result in uneven shearing.

According to an advantageous embodiment, the rolling mill is designed in such a manner that the rolls have different diameters. This makes it possible to obtain the desired difference in peripheral velocity.

According to another advantageous embodiment, the rolls have a different rotational speed. This too makes it possible to obtain the desired difference in rotational speed.

It is also possible for these latter two measures to be combined in order to obtain the desired difference in rotational speed.

The rolling is preferably carried out at an elevated temperature. This makes the rolling run more smoothly. The rolling is preferably carried out at a temperature between 300 and 550° C., since in this temperature range good deformation on the continuously cast aluminum slabs and strip is possible. More preferably, the rolling is carried out at a temperature between 425 and 475° C. The deformation of aluminum is easiest at approximately 450° C.

According to an advantageous embodiment of the method, the slab is introduced between the rolls at an angle of between 5 and 45° with respect to the perpendicular to the plane through the center axes of the rolls. Introducing the slab between the rolls at an angle makes it easier for the rolls to grip the slab, with the result that the change in thickness can be kept as low as possible. Experiments have also shown that after rollins the material has an improved straightness if it is introduced at an angle between the rolls. The slab is preferably fed in at an angle of between 10 and 25°, and more preferably at an angle of between 15 and 25°, since with such an angle the material comes out of the rolling mill with a good level of straightness. It should be noted that the latter effect is also dependent on the reduction in the size of the material, the type of material and the alloy and the temperature.

The starting point is preferably a slab or strip with a thickness of at most 70 mm, more preferably at most 25 mm. Standard rolling involves rolling to a thickness of approximately one millimeter or thinner in order to obtain better mechanical properties. With the aid of the method according to the invention, better mechanical properties can be imparted to the slab or strip, with the result that thinner material can be used for same application. Since the method according to the invention can be used to impart better properties to the relatively thin continuously cast metal, it is to be expected that thicker continuously cast plate and strip material, now with better mechanical properties, will also find industrial applications. For this purpose, after the rolling has been carried out for the first time, the processing operating is preferably repeated one or more times. For example, sufficiently good grain refinement is obtained by carrying out the processing operating according to the invention three times. However, the number of times that the processing operation has to be carried out depends on the thickness of the continuously cast material, the difference in peripheral velocity of the rolls and the desired grain refinement. It is desirable for the material to be introduced between the rolls at an anale of between 5 and 45°, preferably between 10 and 25° and more preferably between 15 and 25° during each processing operation.

By carrying out the processing operation according to the invention a large number of times and subjecting the material to an annealing treatment in between these operations if necessary, it is possible to obtain an ultrafine grain structure. The processing operation can be repeated sufficiently often for the material to become superplastic. Superplastic material has extremely small grains and as a result under certain conditions can stretch almost infinitely without cracking. This is a highly advantageous property for the deformation of metal, for example deep-drawing of a blank. Obviously, when the processing operation according to the invention is repeated a number of times, the material does become thinner, and it is therefore desirable to start from a continuously cast metal, such as aluminum, with the maximum possible thickness.

If the processing operation according to the invention is repeated a number of times, according to an advantageous embodiment the slab, plate or strip can be passed through the rolling mill stand in opposite directions for each pass. The slab, plate or strip then changes direction after each rolling operation and is always passed through the same rolling mill stand. In this case, the rolls have to rotate in opposite directions for each pass. In this case too, it is desirable for the material in each case to be introduced at an angle between the rolls.

According to another advantageous embodiment, the slab, plate or strip is successively passed through two or more rolling mill stands. This method is suitable primarily for strip material, which in this way can undergo the desired processing operation very quickly.

It is possible for the method according to the invention to be preceded or followed by a rolling operation which is carried out using a rolling mill in which the rolls have substantially identical peripheral velocities. In this way, by way of example, an accurately desired thickness or smoothness can be imparted to the product.

According to an advantageous embodiment, the metal slab is formed by two or more layers of metal, preferably two or more layers consisting of different alloys of a metal or different metals. In this way it is possible, for example, to produce laminated material, such as what is known as clad material for, for example, aluminum brazing sheet.

Another aspect of the invention provides a metal plate or strip produced using the above method, in which the metal is aluminum, steel, stainless steel, copper, magnesium or titanium or an alloy of one of these metals. These metals and their alloys are particularly suitable for production with the aid of the method according to the invention, since they are metals which are in widespread use in industry and for which it is very desirable to obtain better mechanical properties if they are produced by continuous casting.

A continuously cast metal plate preferably has a thickness of between 5 and 60 mm, more preferably between 5 and 20 mm. This thickness is obviously dependent on the thickness with which the metal can be continuously cast. Therefore, the processing operation according to the invention makes it possible to produce relatively thick plates with good mechanical properties even from relatively thin continuously cast material.

The plate preferably consists of an aluminum alloy from the AA 1xxx or the AA 3xxx series, preferably AA 1050 or AA 1200, or AA 3103.

A continuously cast metal strip preferably has a thickness of at most 7 mm, more preferably at most 2 mm. By means of the processing operation according to the invention, it is possible to obtain relatively thick strip material with good mechanical properties, although it is also possible, of course, to provide the strip with a standard thickness or even to make it thinner, since the mechanical properties are improved.

The metal strip is, for example, a strip consisting of an aluminum alloy from the AA 5xxx series, preferably AA 5182. This material can be used as auto body sheet as a result of the processing operation according to the invention.

The invention also relates to an improved metal plate or strip which has been produced by continuous casting, preferably with the aid of the method according to the first aspect of the invention, in which the pores in the core of the plate or strip have a maximum dimension of less than 20 μm, preferably less than 10 μm. As a result of the continuous casting, continuously cast plate and strip material always has pores which are significantly larger than 20 μm. The standard rolling operations can only close up these pores in the core to a slight extent or cannot do so at all. The rolling operation according to the invention makes it possible to provide continuously cast plate and strip material having pores which are much smaller.

The invention also relates to an improved metal plate or strip which is produced by continuous casting, preferably with the aid of the method according to the first aspect of the invention, in which the unrecrystallized metal plate or strip, in the core of the plate or billet, has a deformed grain structure, the grain having a mean length which is 2 to 20 times greater than their thickness, preferably a length which is 5 to 20 times greater than their thickness. Since with conventional rolling continuously cast metal is only subject to slight deformation in the core, the metal grains in the core are scarcely deformed. The rolling treatment according to the invention makes it possible to provide continuously cast plate and strip material with highly deformed grains. As a result, a very fine grain structure will be formed during recrystallization.

The invention also relates to an improved metal plate or strip which is produced by continuous casting, preferably with the aid of the method according to the first aspect of the invention, in which the metal plate or strip, after recrystallization, has a substantially homogenous degree of recrystallization over its entire thickness. The fact that the grains have all been subjected to shearing as a result of the rolling operation according to the invention, including those in the core, means that the continuously cast plate and strip material will recrystallize over the entire thickness.

The metal plate or strip with this size of pores, deformed grain structure or this level of recrystallization is preferably made from aluminum, steel, stainless steel, copper, magnesium or titanium or an alloy thereof, since these metals are readily capable of industrial application.

The invention will be explained with reference to an exemplary embodiment.

Experiments were carried out using slabs of aluminum AA7050 with a thickness of 32.5 mm. The slabs were rolled once in a rolling device with two rolls, of which the top roll had a diameter of 165 mm once in a rolling device with two rolls, of which the top roll had a diameter of 165 mm and the bottom roll had a diameter of 135 mm. After rolling, the slabs had a thickness of 30.5 mm.

The slabs were introduced at different angles varying between 50 and 45°. The temperature of the slabs when they were introduced into the rolling device was approximately 450° C. The two rolls were driven at a speed of 5 revolutions per minute.

After rolling, the slabs had a certain curvature, which is highly dependent on the angle of introduction. The straightness of the slab after rolling can to a large extent be determined by the angle of introduction, in which context the optimum angle of introduction will be dependent on the degree of reduction of the slab, the type of material and alloy, and the temperature. For the slabs of aluminum which have been rolled in the experiment described above, an optimum introduction angle is approximately 20°.

A shear angle of 20° was measured in the slabs of aluminum which were rolled in accordance with the experiment described above. Using this measurement and the reduction in the size of the slab, it is possible to calculate an equivalent strain in accordance with the following formula:

$$\epsilon_{eq}=2/\sqrt{3}\cdot\sqrt{(\epsilon_{xx}^2+\epsilon_{yy}^2)}.$$

This formula is used to make it possible to present the strain in one dimension and is known from the book "Fundamentals of metal forming" by R.H. Wagoner and J.L. Chenot, John Wiley & Sons, 1997. Therefore, in the slabs which have been rolled in accordance with the experiment, the equivalent strain is $$\epsilon_{eq}=2/\sqrt{3}\cdot\sqrt{((\ln(32.5/30.5))^2+(1/2(\tan 20°))^2)}=0.25.$$

In the case of rolling with an ordinary rolling mill, shearing does not take place across the thickness of the plate and the equivalent strain is therefore only $$\epsilon_{eq}=2/\sqrt{3}\cdot\sqrt{\ln(32.5/30.5)^2}=0.07$$

(working on the basis of a uniform strain over the entire thickness of the plate).

Therefore, the rolling using the method according to the invention results in an equivalent strain which is three to four times higher than with conventional rolling without any difference in peripheral velocity. A high equivalent strain means less porosity in the slab, greater recrystalization and therefore greater grain refinement, and more extensive breaking up of the second-phase particles (constituent particles) in the slab. These effects are generally known to the person skilled in this field of engineering if the equivalent strain increases. Therefore, the rolling according to the invention means that the resulting properties of the material are greatly improved as a result of the use of the method according to the invention.

The invention claimed is:

1. A method for processing a continuously cast slab or strip, comprising passing the slab or strip between a set of rotating rolls of a rolling mill stand to roll the slab or strip, wherein the rolls of the rolling mill stand have different peripheral velocities, and the difference in peripheral velocity is at least 5% and at most 100%, and the thickness of the slab or strip is reduced by at most 15% for each pass.

2. The method as claimed in claim 1, wherein the thickness of the slab or strip is reduced by at most 8% each pass.

3. The method as claimed in claim 1, wherein the difference in peripheral velocity is at most 50%.

4. The method as claimed in claim 1, wherein the rolling mill rolls have different diameters.

5. The method as claimed in claim 1, wherein the rolls have different rotational speeds.

6. The method as claimed in claim 1, wherein the rolling is carried out at an elevated temperature.

7. The method as claimed in claim 1, wherein the slab is introduced between the rolls at an angle of between 5 and 45° with respect to the perpendicular to the plane through the center axes of the rolls.

8. The method as claimed in claim 1, wherein the slab or strip has a thickness of at most 70 mm at the start of said passing step.

9. The method as claimed in claim 1, wherein the processing operation is repeated one or more times after the rolling has been carried out for the first time.

10. The method as claimed in claim 9, wherein the slab, plate or strip is passed through the rolling mill stand in opposite directions for each pass.

11. The method as claimed in claim 9, wherein the slab, plate or strip is successively passed through two or more rolling mill stands.

12. The method as claimed in claim 1, wherein the processing operation is preceded or followed by a rolling operation carried out using a rolling mill in which the rolls have substantially identical peripheral velocities.

13. Method according to claim 1, wherein the metal slab is formed by two or more layers of metal.

14. The method as claimed in claim 1, wherein the thickness of the slab or strip is reduced by at most 5% each pass.

15. The method as claimed in claim 1, wherein the difference in peripheral velocity is at most 20%.

16. The method as claimed in claim 1, wherein slab or strip comprises aluminum and the rolling is carried out at a temperature between 300 and 550° C.

17. The method as claimed in claim 1, wherein slab or strip comprises aluminum and the rolling is carried out at a temperature between 425 and 475° C.

18. The method as in claim 1, wherein the slab is introduced between the rolls at an angle of between 15 and 25° with respect to the perpendicular to the plane through the center axes of the rolls.

19. The method as in claim 1, wherein the slab or strip has a thickness of at most 25 mm at the start of said passing step.

20. Method according to claim 1, wherein the metal slab is formed by two or more layers consisting of different alloys of a metal or different metals.

21. A method for rolling a continuously cast slab or strip, consisting of:

in a first rolling step passing the slab or strip between a set of rotating rolls of at least one rolling mill stand to roll the slab or strip, wherein the rolls of each said at least one rolling mill stand have different peripheral velocities, respectively, and the difference in peripheral velocity is at least 5% and at most 100%, respectively, and the thickness of the slab or strip is reduced by at most 15% for each pass, and optionally preceding or following the first rolling step by rolling the slab or strip between a set of rotating rolls of at least one rolling mill stand to roll the slab or strip, wherein the rolls of the at least one rolling mill stand have substantially identical peripheral velocities; and optionally annealing the slab or strip after at least one pass of the first rolling step.

22. The method as claimed in claim 21, wherein the thickness of the slab or strip is reduced by at most 8% each pass.

23. The method as claimed in claim 21, wherein the difference in peripheral velocity is at least 20%.

24. The method as in claim 1, wherein the slab is introduced between the rolls at an angle of between 10 and 25° with respect to the perpendicular to the plane through the center axes of the rolls.

* * * * *